US005212426A

United States Patent [19]

Kane

[11] Patent Number: 5,212,426

[45] Date of Patent: May 18, 1993

[54] INTEGRALLY CONTROLLED FIELD EMISSION FLAT DISPLAY DEVICE

[75] Inventor: Robert C. Kane, Woodstock, Ill.

[73] Assignee: Motorola, Inc., Schaumburg, Ill.

[21] Appl. No.: 645,163

[22] Filed: Jan. 24, 1991

[51] Int. Cl.[5] ..... H01J 23/16

[52] U.S. Cl. ..... 315/169.1; 313/309; 313/336

[58] Field of Search ..... 315/169.1; 313/309, 313/336, 351; 340/720, 332, 718

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 4,575,765 | 3/1986 | Hirt | 315/169.3 X |
| 4,721,885 | 1/1988 | Brodie | 313/576 |
| 4,827,177 | 5/1989 | Lee et al. | 313/306 |
| 4,874,981 | 10/1989 | Spindt | 313/309 |
| 4,904,989 | 2/1990 | Matsui et al. | 340/719 |
| 4,908,539 | 3/1990 | Meyer | 315/169.3 |
| 4,940,916 | 7/1990 | Borel et al. | 313/336 |
| 5,007,873 | 4/1991 | Goronkin et al. | 313/309 |

FOREIGN PATENT DOCUMENTS

| | | |
|---|---|---|
| 0172089 | 7/1985 | European Pat. Off. . |
| 2604823 | 10/1986 | France . |
| 855782 | 8/1981 | U.S.S.R. . |
| 2204991A | 11/1988 | United Kingdom . |

OTHER PUBLICATIONS

A Vacuum Field Effect Transistor Using Silicon Field Emitter Arrays, by Gray, 1986 IEDM.

Advanced Technology: flat cold-cathode CRTs, by Ivor Brodie, Information Display Jan. 1989.

Field-Emitter Arrays Applied to Vacuum Flourescent Display, by Spindt et al. Jan., 1989 issue of IEEE Transactions on Electronic Devices.

Field Emission Cathode Array Development For High--Current Density Applications by Spindt et al., dated Aug., 1982 vol. 16 of Applications of Surface Science.

*Primary Examiner*—Eugene R. LaRoche
*Assistant Examiner*—Son Dinh
*Attorney, Agent, or Firm*—Eugene A. Parsons

[57] ABSTRACT

An integrally controlled field emission display device (FED display) is set forth wherein at least a first controller, realized generally as a transistor device, is disposed in/on at least a layer of the FED display and is operably connected to at least one element of the field emission devices of the FED display. A plurality of integrally formed controllers may be selectively interconnected to provide selective control of groups of FEDs of the FED display in a manner that provides for integrated active addressing of the FED display.

11 Claims, 4 Drawing Sheets

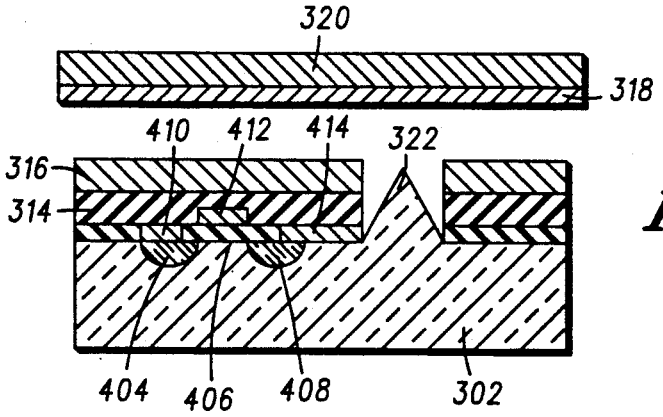
FIG. 4
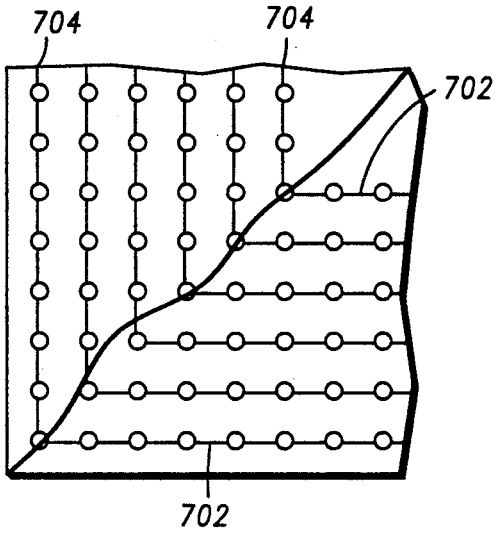
FIG. 7
FIG. 5
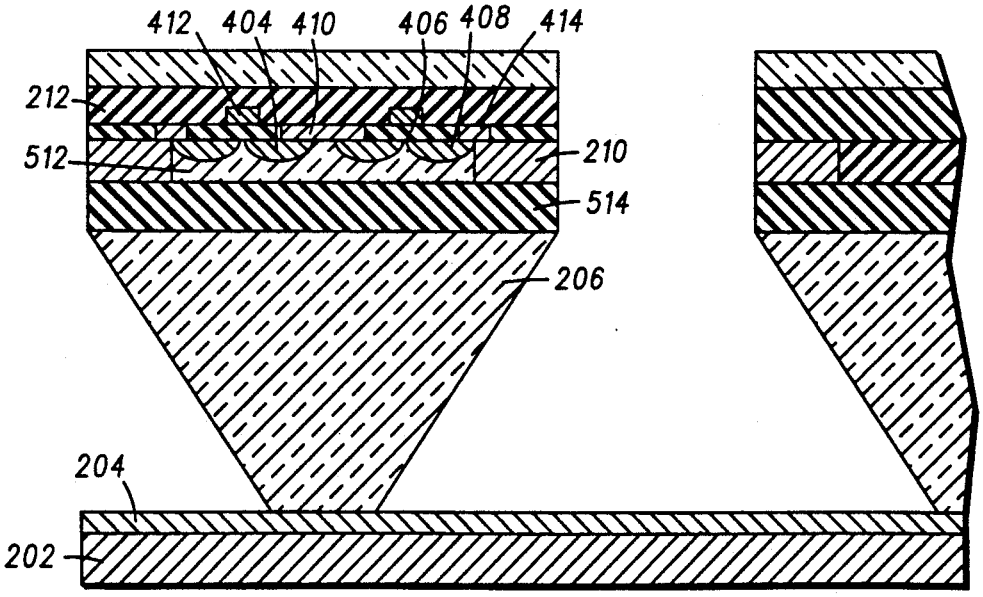

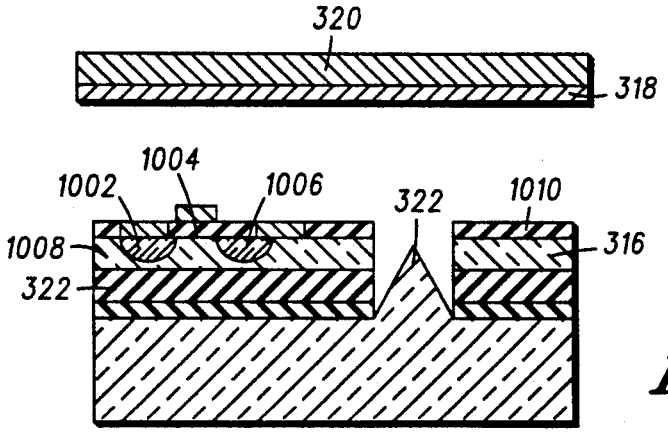
FIG.10
FIG.11
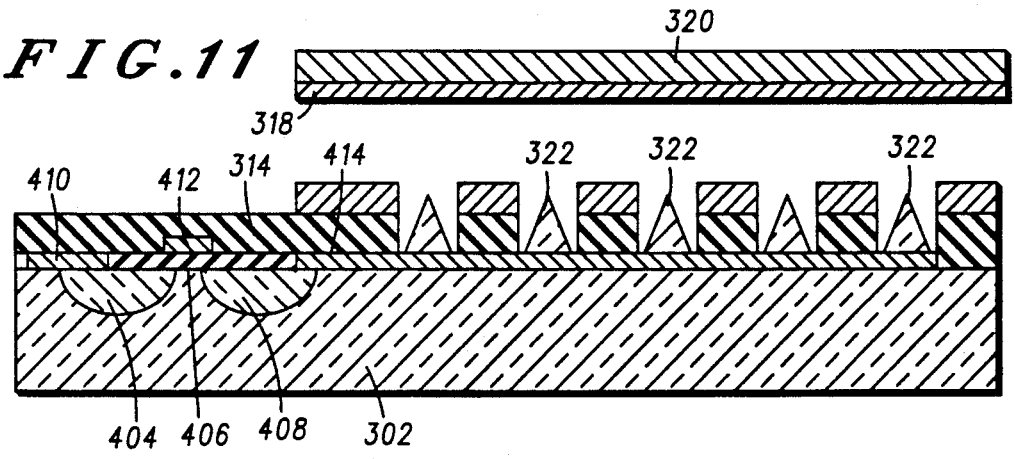
FIG.12
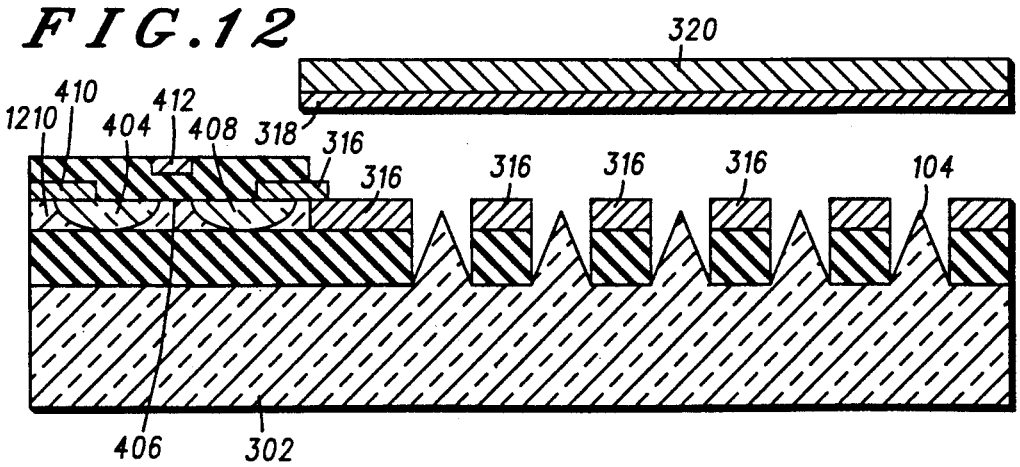

INTEGRALLY CONTROLLED FIELD EMISSION FLAT DISPLAY DEVICE

FIELD OF THE INVENTION

The present invention relates generally to cold-cathode filed emission devices and more particularly to field emission devices employed in flat displays.

BACKGROUND OF THE INVENTION

Flat display technologies such as plasma, liquid crystal display, and electroluminescence have permitted relatively thin flat displays in contrast to cathode ray tube technology. However, these prior art flat display technologies provide display performance that is in many respects inferior to that of cathode ray tube methodology.

Field emission devices (FEDs) can provide better display performance than that of plasma, liquid crystal, and electroluminescent flat display devices. FEDs utilized in flat displays are known in the art, but present FED flat displays do not employ on-board, integral control of pixel energizing electron sources. Such on-board control would provide for simplification of external circuitry requirements for flat displays, thereby also improving flexibility of use. Thus, there is a need for an FED flat display that incorporates on-board, integral control of pixel energizing electron sources.

SUMMARY OF THE INVENTION

This need and others are substantially met through provision of an integrally controlled cold-cathode field-induced electron emission display device having at least a first device anode, at least a first device non-insulating gate layer, and at least a first device electron emitter, comprising at least: a supporting substrate with at least a primary surface; at least a first integral controller, substantially disposed in/on at least one of:

the supporting substrate;

the at least first device non-insulating gate layer; and an at least first device electron emitter layer; and being operably connected to at least one of: the at least first device anode and, as desired, to further device anodes; the at least first device non-insulating gate layer; and the at least first device electron emitter; the at least first device electron emitter, for emitting electrons, being operably connected to the at least primary surface of the supporting substrate, and wherein the at least first device anode is substantially distally disposed with respect to the at least first device electron emitter; a first insulator layer at least partially disposed on the at least primary surface of the supporting substrate and having at least a first aperture therein, such that each desired device electron emitter is substantially symmetrically disposed within each desired at least first aperture, and such that the at least first device non-insulating gate layer is substantially disposed on at least part of the at least first insulator layer substantially peripherally symmetrically about each desired device electron emitter; at least a first cathodoluminescent layer that is operably connected to/substantially disposed on the at least first device anode, such that at least some of any emitted electrons impinge on at least a part of the at least first cathodoluminescent layer, and such that the at least first cathodoluminescent layer is distally disposed with respect to at least a first desired device electron emitter of the device electron emitter(s) substantially symmetrically disposed within each desired at least first aperture; such that at least some of any emitted electrons impinging on the at least first cathodoluminescent layer are collected by at least the first device anode to provide at least a first display.

BRIEF DESCRIPTION OF THE DRAWINGS

FIG. 4 is a side-elevational cross-sectional depiction of a second embodiment of an integrally controlled FED flat display device in accordance with the present invention.

FIG. 5 is a side-elevational cross-sectional depiction of a third embodiment of an integrally controlled FED flat display device in accordance with the present invention.

FIG. 7 is a partial top plan partial cut-away view depicting orthogonal emitter column lines and gate row lines of a FED flat display.

FIG. 10 is a side-elevational cross-sectional depiction of a seventh embodiment of an integrally controlled FED flat display device in accordance with the present invention.

FIG. 11 is a side-elevational cross-sectional depiction of an eighth embodiment of an integrally controlled FED flat display device in accordance with the present invention.

FIG. 12 is a side-elevational cross-sectional depiction of a ninth embodiment of an integrally controlled FED flat display device in accordance with the present invention.

DETAILED DESCRIPTION OF A PREFERRED EMBODIMENT

Figure 1:
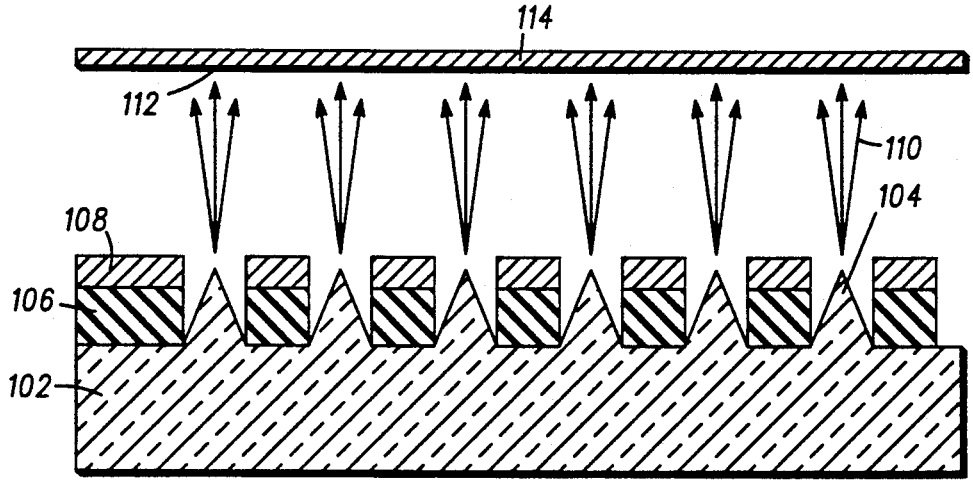
FIG. 1 is a side-elevational cross-sectional depiction of a flat display device utilizing FEDs with device electron emitters disposed on a supporting substrate as is known in the prior art.

FIG. 1 is a side-elevational cross-sectional drawing of a conventional flat display device utilizing FEDs. A substrate layer(102) is typically utilized to support device electron emitters (104), which device electron emitters (104) are disposed substantially symmetrically within apertures of an insulator layer (106) that is disposed on the substrate (102). Extraction gate electrodes (108), if desired, may be disposed on the insulator layer (106). Device electron emitters (104) are generally oriented such that electron emission (110), which preferentially takes place from regions of geometric discontinuity of small radius of curvature, is substantially directed toward a distally disposed anode (114), which anode (114) is comprised of a substantially transparent viewing screen on which a substantially transparent conductive coating, for collecting at least some of any emitted electrons, is deposited. Disposed on the anode (114) and in the intervening region between the anode (114) and the device electron emitters (104) is a layer of cathodoluminescent material (112). At least some of any emitted electrons traversing the region between the device electron emitters (104) and the anode (114) will impinge on the cathodoluminescent material and impart energy to the cathodoluminescent material, resulting in subsequent luminescence as is known in the prior art. Alternatively, the conductive anode material may be substantially optically opaque, such as, for example, aluminum, in which instance the conductive anode material would preferentially be disposed on a surface of the cathodoluminescent material not in contact with the transparent viewing screen, as is known in the prior art.

Figure 2:
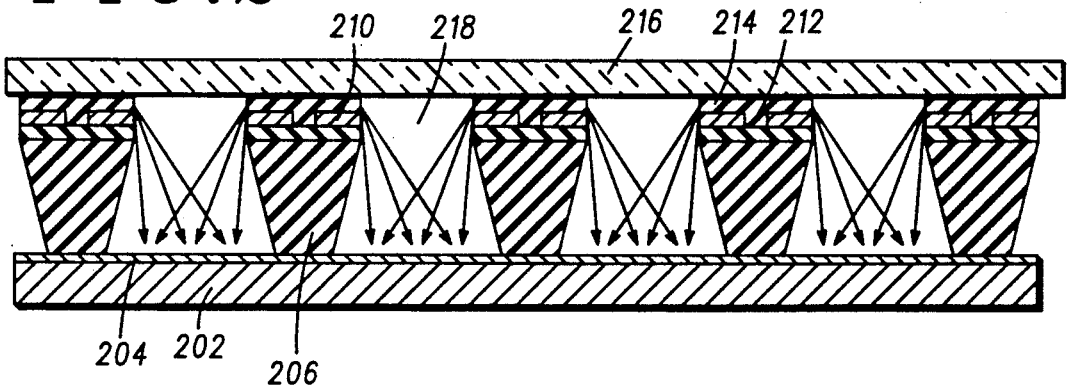
FIG. 2 is a side-elevational cross-sectional depiction of a flat display device utilizing FEDs wherein a cathodoluminescent layer and device anode are substantially disposed on a supporting substrate as is known in the prior art.

FIG. 2 is a side-elevational cross-sectional depiction of a conventional flat display employing FEDs, wherein an anode (202) comprises a substantially optically transparent viewing screen on which is deposited a substantially optically transparent conductive coating, for collecting at least some of any emitted electrons. A layer of cathodoluminescent material (204) is disposed on at least a part of the conductive coating. A first insulator layer (206) having a plurality of apertures (218) is disposed on the layer of cathodoluminescent material (204). Subsequent layers include at least a second layer of insulating material (212), at least a first layer of non-insulating material (210), at least a second layer of non-insulating material (214), and, if desired, an encapsulation layer (216). In this embodiment of an FED display device, a structure is formed wherein the anode (202) further serves as a supporting substrate for the device. Application of appropriate potentials to the various electrodes of the device will result in the at least second layer of non-insulating material (214) functioning as a device electron emitter, while the first layer of non-insulating material (210) will function as a gate extraction electrode for inducing electron emission (208) from a region of geometric discontinuity of small radius of curvature of the device electron emitter. In this embodiment, the geometric discontinuity of small radius of curvature is realized as an edge of the at least second layer of non-insulating material (214), substantially disposed at least partially about a periphery of the apertures (218), depicted in cross-sectional format in FIG. 2.

Figure 3:
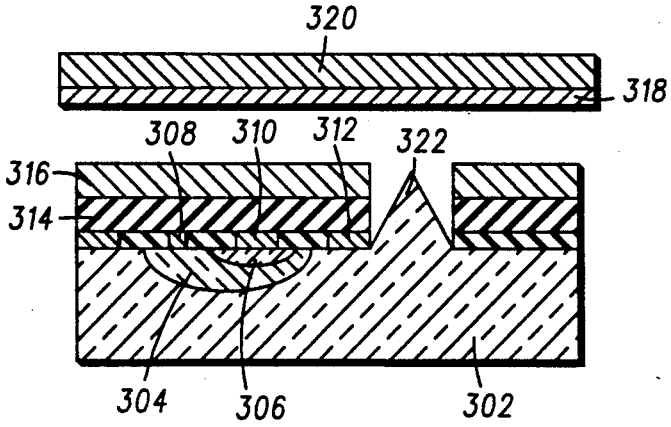
FIG. 3 is a side-elevational cross-sectional depiction of a first embodiment of an integrally controlled FED flat display device in accordance with the present invention.

FIG. 3 is a side elevational cross-sectional view of a first embodiment of an integrally controlled FED display in accordance with the present invention. The integrally controlled FED of the first embodiment includes at least a first integral controller (302, 304, 306), embodied substantially as a first bipolar transistor having a transistor collector (302), a transistor base (304), and a transistor emitter (306). The at least first integral controller (302, 304, 306) is substantially disposed in/on a first supporting substrate having at least a first surface. The transistor base (304) is operably coupled to at least a first conductive line (308), thereby providing an interconnection path by which externally applied potentials or signals may be impressed at the transistor base (304). The transistor emitter (306) is operably coupled to at least a second conductive line (310), thereby providing an interconnection path by which externally applied potentials or signals may be impressed at the transistor emitter (306). In the embodiment shown in FIG. 3, the transistor collector (302) is operably coupled to a third conductive path (312), which conductive path (312) resides substantially on a material that forms the transistor collector (302), and that further provides a base on which at least a first device electron emitter (322) is substantially disposed. The third conductive path (312) may also provide an interconnection path by which externally applied potentials and signals may be impressed at the transistor collector/device electron emitter (302/322).

FIG. 3 further depicts an at least first insulator layer (314) disposed on at least a part of the first integral controller (302, 304, 306), and further disposed on at least a part of each of the first, second, and third conductive lines (308, 310, 312). An at least first device non-insulating gate layer (316) is substantially disposed on at least a part of the at least first insulating layer (314) and is substantially symmetrically axially disposed with respect to the at least first device electron emitter (322). The non-insulating gate layer (316) may be comprised of a variety of conductive/semiconductive materials, such as, for example, molybdenum, titanium, copper, aluminum, gold, silver, or non-intrinsic silicon.

Also shown in FIG. 3 is an at least first device anode (320), comprised of at least a substantially optically transparent viewing screen on which is disposed a substantially optically transparent conductive layer, for collecting at least some of any emitted electrons, and that is substantially distally disposed with respect to the at least first device electron emitter (322). At least a first layer of cathodoluminescent material (318) is substantially disposed on the substantially optically transparent conductive layer of the at least first device anode (320) and in an intervening space between the at least first device anode (320) and the at least first device electron emitter (322).

As depicted in FIG. 3 and subsequently described, the integrally controlled FED display device will be operably controlled by the at least first integral controller (302, 304, 306), a bipolar transistor in this first embodiment, when appropriate external potentials and/or signals are applied to at least some of the first, second, and third conductive lines (308, 310, 312) in a manner that determines an availability of electron charge carriers (electrons) to the device electron emitter (322) at substantially the same time that an extraction potential is provided to the non-insulating gate layer (316). Availability of electrons at the at least first device electron emitter (322) in concert with a proximal electric field, induced by providing an appropriate potential at the non-insulating gate layer (316) near a tip of the at least first device electron emitter (322), which tip comprises a region of geometric discontinuity of small radius of curvature, will result in electrons being emitted into the intervening region between the at least first device electron emitter (322) and the at least first device anode (320) such that, with a suitable anode potential provided, at least some emitted electrons will impinge on the at least first layer of cathodoluminescent material (318). At least some of any emitted electrons impinging on the at least first layer of cathodoluminescent material (318) will transfer at least some energy to electrons residing in a lattice structure of the at least first cathodoluminescent layer (318), such that the energized lattice electrons may revert to unexcited state(s), emitting photons. Thus, the at least first integral controller (302, 304, 306) that is integrally formed within the display device provides a means by which electron emission may be controlled and modulated.

FIG. 4 depicts a side-elevational cross-sectional view of a second embodiment of an integrally controlled FED display device in accordance with the present invention, setting forth an at least first integral controller (404, 406, 408) that is embodied as a field effect transistor having a source (404), a channel (406), and a drain (408). The transistor source (404) is operably coupled to a first conductive line (410). The transistor drain is operably coupled to a third conductive line (414) that further provides a base layer on which an at least first device electron emitter (322) is substantially disposed. A second conductive line (412) is operably distally disposed with respect to the transistor channel (406) in a manner commonly known in the art to realize a gate structure of a field effect transistor. The second embodiment of an integrally controlled FED display device set forth in FIG. 4 will operate similarly to the device described previously with reference to FIG. 3, wherein the integral controller (404, 406, 408) for the device of FIG. 4 is a field effect transistor.

FIG. 5 is a side-elevational cross-sectional view of a third embodiment of an integrally controlled FED display device in accordance with the present invention. The display device of FIG. 5, an embodiment improving a display device that is constructed in accordance with FIG. 2, further comprises at least a first integral controller (404, 406, 408) and first, second, and third conductive lines (410, 412, 414), as described previously with reference to FIG. 4, wherein the at least first integral controller may be substantially disposed in a layer of semiconductive material (512), which layer of semiconductive material is shown disposed substantially on an insulator layer (514) and is further disposed in the intervening region between FED gate electrodes of a non-insulating gate layer (210). Alternatively (not as depicted), the integrated controller may be substantially disposed in/on the at least first layer of non-insulating gate layer (210), wherein the non-insulating gate layer comprises semiconducting material.

As shown, the third conductive line (412), which line, as previously described, is operably coupled to the drain (408), is further operably coupled to the gate electrode of the non-insulating layer (210) such that by selectively providing potentials and signals to at least some of the first, second, and third conductive lines (410, 412, 414), an electric field induced proximal to an emitting edge of the device electron emitter of the at least second layer of non-insulating material (214) may be selectively determined to control and modulate a rate of electron emission from the device electron emitter.

Figure 6:
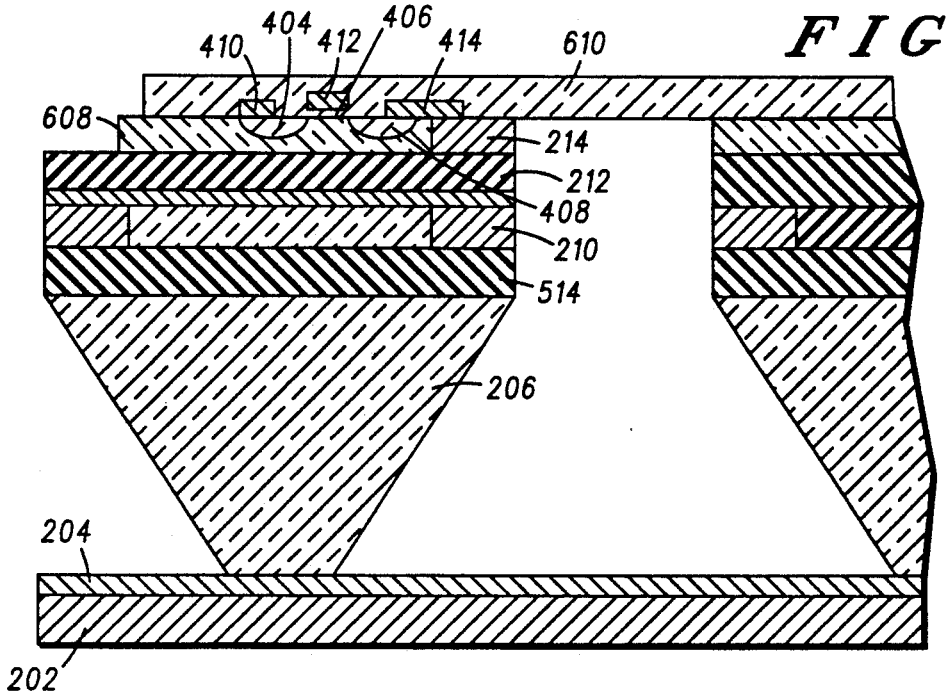
FIG. 6 is a side-elevational cross-sectional depiction of a fourth embodiment of an integrally controlled FED flat display device in accordance with the present invention.

FIG. 6 is a side-elevational cross-sectional view of a fourth embodiment of an integrally controlled FED display device in accordance with the present invention. The FED display device previously described with reference to FIG. 2 is improved by the present invention that further comprises at least a first integral controller (404, 406, 408) and first, second, and third conductive lines (410, 412, 414), described previously with respect to FIG. 4, wherein the integrally controlled FED display device of FIG. 4 alternatively employs the integral controller (404, 406, 408) disposed in a device electron emitter layer comprised of a layer of semiconductor material (608), which layer of semiconductor material (608) is substantially disposed on at least a part of the at least second layer of insulating material (212). The third conductive path (414) provides operable coupling of the drain (408) to the emitter electrode of the second layer of non-insulating material (214). In an alternative embodiment (not depicted) the integral controller may be disposed in the second layer of non-insulating material (214). At least a first encapsulating insulating layer (610), if desired, substantially disposed on at least a part of the layer of non-insulating material (214) and on at least a part of the layer of semiconductor material (608), provides an integral seal for the display device. As described and depicted, the integrally controlled FED display device of FIG. 6 will operably control the operation of the display device by controlling and modulating an availability of electrons that may be emitted by the at least first device electron emitter of the at least second non-insulating layer (214).

FIG. 7 is a partial top plan cutaway depiction of a possible configuration of an array of a plurality of integrally controlled FED display devices such as those described in FIG. 2, wherein each substantially circular region comprises an individual FED display element. For the depiction shown, a first group of conductive lines (702) of the cutaway top section may, for example, provide an interconnection of rows of individual gate electrodes, while a second group of lines (704) may provide interconnecting columns of device electron emitters.

Figure 8:
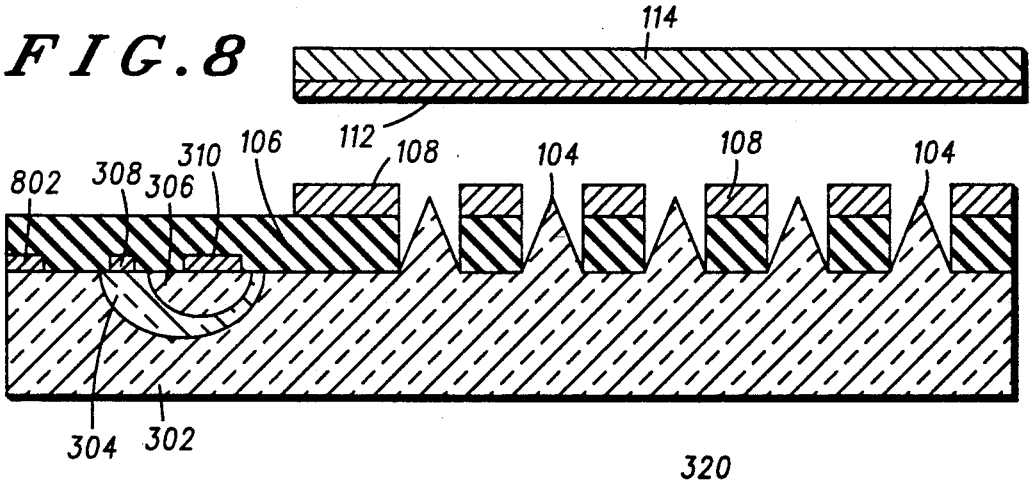
FIG. 8 is a side-elevational cross-sectional depiction of a fifth embodiment of an integrally controlled FED flat display device in accordance with the present invention.

FIG. 8 is a side-elevational cross-sectional view of a fifth embodiment of an integrally controlled FED display device in accordance with the present invention. The display device improves the display device previously described in FIG. 1, further comprising a plurality of cells that are controlled by an integral controller (302, 304, 306) that is previously described with reference to FIG. 3. In the fifth embodiment the device electron emitters (104) are substantially disposed directly on the transistor collector (302). Alternatively (not depicted), the device electron emitters (104) may be disposed onto a conductive line, such as, for example, the third conductive line (312), described previously with reference to FIG. 3. A fourth conductive line (802) is operably connected to the transistor collector (302) and provides an interconnect path whereby external potential and signals mays be impressed onto the transistor collector (302). The integrally controlled FED display device so depicted and described provides for control of a plurality of FED display elements, such as, for example, a column of FED display pixels, by a single integral controller.

Figure 9:
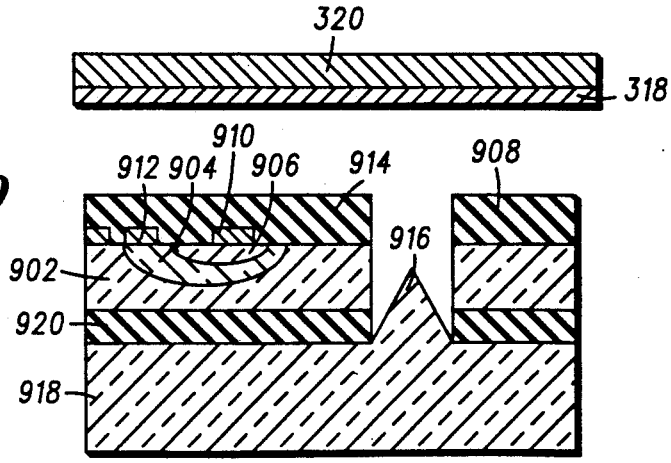
FIG. 9 is a side-elevational cross-sectional depiction of a sixth embodiment of an integrally controlled FED flat display device in accordance with the present invention.

FIG. 9 is a side-elevational cross-sectional view of a sixth embodiment of an integrally controlled FED display device in accordance with the present invention, wherein at least a first integral controller (902, 904, 906) is realized as a bipolar transistor comprised of a transistor emitter (906), a transistor base (904), and a transistor collector (902), which transistor collector (902) further functions as a gate extraction electrode of the FED. At least a first device electron emitter (916) is substantially disposed on at most a part of a surface of a supporting substrate (918). At least a first insulating layer (920) is disposed on at least a part of a surface of the supporting substrate (918) and is comprised of at least a first aperture, which aperture(s) substantially symmetrically peripherally distally surrounds each device electron emitter (916). An at least first non-insulating layer (902), which non-insulating layer (902) also functions as the the transistor collector (902), is substantially disposed on at least a part of the at least first insulating layer (920) substantially symmetrically peripherally at least partially about each desired device electron emitter (916). At least first, second, and third conductive lines (910, 912, 914) are provided as interconnects whereby external potentials and signals may be impressed on the elements of the at least first integral controller (902, 904, 906). An at least second insulator layer (908) is provided, if desired, and may function as a spacer. An anode (320) and cathodoluminescent layer (318) function as previously described for FIG. 3. In the sixth embodiment, the at least first integral controller (902, 904, 906) is disposed in a manner which provides for control of a potential at the gate extraction electrode (902), thereby controlling and/or modulating an electric field induced proximal to the at least first device electron emitter (916), determining a rate of electron emission from the at least first device electron emitter (916), and subsequently, the illumination of the display device.

FIG. 10 is a side-elevational cross-sectional view of a seventh embodiment of an integrally controlled FED display device in accordance with the present invention, wherein at lest a first integral controller (1002, 1004, 1006) is embodied as a field effect transistor. The at least first integral controller (1002, 1004, 1006) is substantially disposed in at least a first non-insulating layer (1008), which at lest first non-insulating layer (1008) also functions as an FED gate extraction electrode and is disposed substantially peripherally symmetrically with respect to the at least first device electron emitter (322). At least a second insulating layer (1010) is provided, which layer provides a base for at least some of the conductive lines, described previously with respect to FIG. 4, that are employed by the field effect transistor of the at least first integral controller (1002, 1004, 1006). In this embodiment, the at least first integral controller (1002, 1004, 1006) may be employed to control an FED display device as previously described for FIG. 9.

FIG. 11 is a side-elevational cross-sectional view of an eighth embodiment of an integrally controlled FED display device in accordance with the present invention, wherein at least a plurality of FEDs are operably coupled to at least a first integral controller (404, 406, 408), realized in this embodiment as a field effect transistor that functions in concert with at least the plurality of FEDs as described previously with reference to FIGS. 4 and 8.

FIG. 12 is a side-elevational cross-sectional view of an eighth embodiment of an integrally controlled FED display device in accordance with the present invention, wherein at least a plurality of FEDs are integrally controlled by at least a first integral controller (404, 406, 408), which controller is realized in this embodiment as a field effect transistor, such that the at least first integral controller (404, 406, 408) is substantially disposed in an at least first layer of non-insulating material (1210) that is disposed as previously described for FIG. 5. The integrally controlled FED display device of FIG. 12 employs at least a plurality of FEDs, each functioning as previously described for FIG. 10, and each controlled by the at least first integral controller (404, 406, 408).

In some applications non-insulating layer(s) typically may consist of at least one semiconductor material, such as silicon, germanium, and gallium arsenide. Further, commonly known methods of disposing said non-insulator layers may be employed to yield, for example, amorphous silicon or polycrystalline silicon non-insulating layer(s).

Integrally controlled FED flat displays will provide for internally controlled displays, thereby simplifying external circuitry requirements. Thus such flat displays will be more flexibly and more inexpensively incorporated into electrical devices.

I claim:

1. An integrally controlled cold-cathode field-induced electron emission display device having a device anode, a device non-insulating gate layer, and a device electron emitter, comprising:

A) a supporting substrate with a primary surface;

B) an integral controller including one of a bipolar transistor and a field-effect transistor, the integral controller being substantially disposed in at least one of:

the supporting substrate;

the device non-insulating gate layer; and a device electron emitter layer;

and being operably connected to at least one of:

the device anode;

the device non-insulating gate layer; and the device electron emitter;

the device electron emitter being operably connected to the primary surface of the supporting substrate, and wherein the device anode is substantially distally disposed with respect to the device electron emitter;

C) an insulator layer disposed on the primary surface of the supporting substrate and having an aperture therein, such that the electron emitter is substantially symmetrically disposed within the aperture, and such that the device non-insulating gate layer is disposed on the insulator layer substantially peripherally symmetrically about the device electron emitter; and D) a cathodoluminescent layer that is operably connected to/substantially disposed on the device anode, such that at least some of any emitted electrons impinge on the cathodoluminescent layer, and such that the cathodoluminescent layer is distally disposed with respect to the device electron emitter substantially symmetrically disposed within the aperture;

such that at least some of any emitted electrons impinging on the cathodoluminescent layer are collected by the device anode to provide a display.

2. The integrally controlled cold-cathode field-induced electron emission device of claim 1, further comprising a plurality of field emission devices (FEDs) operably controlled by the integral controller.

3. The integrally controlled cold-cathode field-induced electron emission device of claim 1, further comprising a plurality of field emission devices (FEDs) selectively operably interconnected as rows/columns of FEDs, and wherein each row/column of FEDs is operably controlled by the integral controller.

4. An integrally controlled cold-cathode field-induced electron emission display device having a device anode, a device non-insulating gate layer, and a device electron emitter, comprising:

A) a supporting substrate with a primary surface;

B) an integral controller including one of a bipolar transistor and a field-effect transistor, the integral controller being substantially disposed in at least one of:

the supporting substrate;
the device non-insulating gate layer; and
a device electron emitter layer;
and being operably connected to at least one of:
the device anode;
the device non-insulating gate layer;
a conductive layer; and
the device electron emitter;
the device electron emitter being operably connected to at least one of:
the primary surface of the supporting substrate; and
the conductive layer;

C) an insulator layer, at least partially disposed on one of:
the primary surface of the supporting substrate;
the conductive layer at least partially disposed on/in the primary surface of the supporting substrate; and
the integral controller;
and having an aperture therein such that the aperture has disposed, therein, a device electron emitter;

D) a cathodoluminescent layer disposed on at least a part of the device anode, wherein the device anode is substantially distally disposed with respect to the device electron emitter;

such that at least some of any emitted electrons impinging on the cathodoluminescent layer are collected by the device anode to provide a display.

5. The integrally controlled cold-cathode field-induced electron emission device of claim 4, further comprising a plurality of field emission devices (FEDs) operably controlled by the integral controller.

6. The integrally controlled cold-cathode field-induced electron emission device of claim 4, further comprising at least a plurality of field emission devices (FEDs) selectively operably interconnected as rows/columns of FEDs, and wherein each row/column of FEDs is operably controlled by the integral controller.

7. A method for constructing an integrally controlled cold-cathode field-induced electron emission display device having a device anode, a device non-insulating gate layer, and a plurality of device electron emitters, comprising the steps of:

A) providing a supporting substrate with a primary surface;

B) forming an integral controller including one of a bipolar transistor and a field-effect transistor, the integral controller being substantially disposed in at least one of:
the supporting substrate;
the device non-insulating gate layer; and
a device electron emitter layer;
and being operably connected to at least one of:
the device anode;
the device non-insulating gate layer; and the plurality of device electron emitters;
the plurality of device electron emitters being operably connected to the primary surface of the supporting substrate, and wherein the device anode is substantially distally disposed with respect to the plurality of device electron emitters;

C) depositing an insulator layer at least partially on the primary surface of the supporting substrate and having a plurality of apertures therein, such that each of the plurality of device electron emitters is substantially symmetrically disposed within an aperture, and such that the device non-insulating gate layer is substantially disposed on at least part of the insulator layer substantially peripherally symmetrically about each device electron emitter; and D) depositing a cathodoluminescent layer that is operably connected to the device anode, such that at least some of any emitted electrons impinge on the cathodoluminescent layer, and such that the cathodoluminescent layer is distally disposed with respect to the device electron emitters;

such that at least some of any emitted electrons impinging on the cathodoluminescent layer are collected by the device anode to provide a display.

8. The method of claim 7, further comprising a plurality of field emission devices (FEDs) operably controlled by the integral controller.

9. The method of claim 7, further comprising at least a plurality of field emission devices (FEDs) selectively operably interconnected as rows/columns of FEDs, and wherein each row/column of FEDs is operably controlled by the integral controller.

10. A method for constructing an integrally controlled cold-cathode field-induced electron emission display device having a device anode, a device non-insulating gate layer, and a device electron emitter, comprising the steps of:

A) providing a supporting substrate with a primary surface;

B) depositing an integral controller including one of a bipolar transistor and a field-effect transistor, the integral controller being substantially disposed in at least one of:
the supporting substrate;
the device non-insulating gate layer; and
a device electron emitter layer;
and being operably connected to at least one of:
the device anode;
the device non-insulating gate layer;
a conductive layer; and
the device electron emitter;
the device electron emitter being operably connected to at least one of:
the primary surface of the supporting substrate; and
the conductive layer;

C) depositing an insulator layer, at least partially on one of:
the primary surface of the supporting substrate;
the conductive layer at least partially disposed on/in the primary surface of the supporting substrate; and
the integral controller; and having an aperture therein such that the aperture has disposed, substantially symmetrically therein the device electron emitter; and D) depositing a cathodoluminescent layer on the device anode, wherein the device anode is substantially distally disposed with respect to the device electron emitter;

such that at least some of any emitted electrons impinging on the cathodoluminescent layer are collected by the device anode to provide a display.

11. A method for constructing an integrally controlled cold-cathode field-induced electron emission device as claimed in claim 10, further comprising a step of constructing a plurality of field emission devices (FEDs) selectively operably interconnected as rows/columns of FEDs, and wherein each row/column of FEDs is operably controlled by the integral controller.

* * * * *